US006620082B1

(12) United States Patent
Siegel

(10) Patent No.: US 6,620,082 B1
(45) Date of Patent: Sep. 16, 2003

(54) EXERCISE DEVICE

(76) Inventor: David S. Siegel, 4818 Sea Oats Cir., Apt. 207, West Palm Beach, FL (US) 33417

( * ) Notice: Subject to any disclaimer, the term of this patent is extended or adjusted under 35 U.S.C. 154(b) by 12 days.

(21) Appl. No.: 09/693,442

(22) Filed: Oct. 21, 2000

(51) Int. Cl.[7] ..... A63B 21/00
(52) U.S. Cl. ..... 482/126; 482/124; 482/139
(58) Field of Search ..... 482/121, 122, 482/123, 124, 125, 126, 139

(56) References Cited

U.S. PATENT DOCUMENTS

| | | | |
|---|---|---|---|
| 4,428,577 | A | 1/1984 | Weingardt |
| 4,720,096 | A | 1/1988 | Rogers |
| 5,031,906 | A | 7/1991 | Jang |
| 5,042,799 | A | 8/1991 | Stanley |
| 5,613,928 | A | 3/1997 | Laudone |
| 5,634,874 | A | 6/1997 | Kest et al. |
| 5,720,700 | A | 2/1998 | Buoni et al. |
| 5,741,207 | A | 4/1998 | Buoni et al. |
| 5,830,110 | A | 11/1998 | Fielding |

*Primary Examiner*—Stephen R. Crow
(74) *Attorney, Agent, or Firm*—McHale & Slavin, P.A.

(57) ABSTRACT

The present invention is a device for effectively isolating the shoulder joints and surrounding musculature to provide a strength and conditioning effect while maintaining flexibility about the joint. More specifically, the instantly disclosed apparatus is a butterfly exercise device useful for isolating the pectoral and deltoid muscle groups while rotating the shoulder joint and forearm areas of the user. In its most basic form the device includes first and second members which are constructed and arranged to accept the user's forearm and hand. These members are hingedly engaged and are maintained in a first position by variable resistance means. A force, exerted by the user's forearms in opposition to the variable resistance means, moves the first and second members to a second position, followed by completion of the repetition by returning to the initial position. While accomplishing the repetition, the user simultaneously rotates both shoulder joints to enhance flexibility while conditioning both the deltoid and pectoral muscle groups.

9 Claims, 3 Drawing Sheets

EXERCISE DEVICE

FIELD OF THE INVENTION

This invention relates to an apparatus for exercising the forearms and upper body, and particularly relates to an exercise device for isolating the pectoral and deltoid muscle groups while rotating the shoulder joint and forearm areas.

BACKGROUND OF THE INVENTION

Exercise is required to maintain both cardiovascular fitness and overall muscle tone. Exercise can generally be divided into two distinct types; a first type which is designed to achieve cardiovascular fitness and a second type which is designed to emphasize conditioning of one or more specific muscle groups.

When a particular portion of the body is selected, it is often necessary to design a device which isolates the particular group of muscles for which conditioning is desired. In addition to strength and conditioning of the muscle groups, flexibility of the joints is also a prime concern.

It is often difficult to effectively isolate the desired muscle group since related muscle groups, which are in close proximity to the targeted group, will often be unintentionally brought into play. This is especially true when the user becomes fatigued and "cheats" allowing alternative muscle groups to be exercised at the expense of the targeted group.

The butterfly exercise is designed to isolate certain muscles of the chest, shoulders, upper arms and particularly the pectoral muscle groups. There are numerous devices which have attempted to effectively isolate these groupings. As generally performed, the butterfly press device places the exerciser in a standing or sitting position and in an upright posture. The arms are placed in an extended position and are bent upwardly so that the hands generally extend above the shoulders with the forearms oriented vertically and the upper arms generally horizontal. The hands engage the machine and the exercise is performed by the user pressing against the machine's resistance, moving in an arcuate path which results in the user's arms coming together in front of the user and then being brought back to the sides, thus completing one repetition.

DESCRIPTION OF THE PRIOR ART

U.S. Pat. No. 5,634,874 teaches a portable exercise device for exercising the upper anatomy. The portable exercise device includes a slide assembly having a pair of cooperating curved slides and a rack formed on each of the slides. A spring-biased elastic resistance mechanism having a pinion is interdisposed between the cooperating slides to generate resistance to relative movement of the slides. The resistance mechanism further includes a brake disc assembly in combination with a clutch assembly for providing frictional resistance in a single direction. A grip assembly including a pair of arms pivotally connected at opposite ends of the cooperating slides are positionable between a stowed position for storing and transporting the device, and an extended position for placing the user's arms in the appropriate position for performing the fly type exercise as heretofore described.

U.S. Pat. No. 4,720,096 describes a device to be used in performing chest exercises. It comprises two interconnected levers to which standard weight plates may be attached. A torsional spring provides resistance to the bringing together of the free ends of the levers. To use the device, a person, after affixing suitable weight plates to the device, lies on his back and grips the levers near their free ends. He then pushes the device upwardly in a bench-press type motion, and forces his hands together against the resistance of the spring. The novel U-shaped frame is of use in other standard exercises such as squatting movement, calf raises, bent over bows, and shrugs.

U.S. Pat. No. 5,830,110 is drawn toward a spring-actuated, portable weight training device. The spring-actuated, portable weight training device includes a first compression assembly comprising a first compression spring, a second compression assembly comprising a second compression spring, an extension assembly for receiving the first and second compression assemblies, means for removably affixing the compression assemblies to the extension assembly, and means for compressing the first and second compression assemblies over the extension assembly, which compression assembly compression means preferably comprises either a pair of abdominal adapters or a pair of forearm securing elements or a pair of thigh adapters pivotably attached to the compression assemblies. The extension assembly comprises an adjustable strut having a plurality of openings along its length, a fixed strut having one opening along its length and capable of receiving the adjustable strut, and a pushbutton for removably securing the adjustable strut to the fixed strut, in order to accommodate users of various sizes and strengths.

U.S. Pat. No. 5,031,906 discloses a versatile exercising machine, comprising two symmetric handles each having mounting holes at one side for mounting a compression link or three elastic cords, and two pairs of T-shaped blocks respectively releasably connected to the two symmetric handles at two opposite ends thereof. By combining the two pairs of T-shaped blocks with the two symmetric handles, two stands are formed for push-up exercise. By attaching the compression link to the two handles, an exercising unit is provided for exercising the muscles of the upper and lower extremities and the abdomen. By attaching the elastic cords to the two handles, a chest expander is formed for developing the muscles of the chest.

U.S. Pat. 4,428,577 teaches an exercise device having a flexible steel blade with handles attached to each end and each handle having a plurality of hand grip members progressively outwardly spaced for hand engagement by the user with the flexible steel blade being enclosed in a foam rubber cloth covered cushion.

U.S. Pat. No. 5,741,207 teaches a portable whole body exercise device that utilizes a rigid hollow tube and two elastic cords that may have different tensions. Elastic cord runs lengthwise through the hollow tube, while an additional elastic cord is connected between the open ends of the tube.

U.S. Pat. No. 5,720,700 is drawn to a portable whole body exercise device which utilizes at least one hollow tube and several cords having different tensions for allowing a user to exercise his or her muscles. The exercise device includes elastic cords extending out of open ends of the hollow tube, and another elastic cord connected between the open ends of the tube.

U.S. Pat. No. 5,042,799 is directed toward a portable exercise device for exercising and strengthening a user's arm and leg muscles which utilizes a-spring mechanism connected to an adjustable lever arm which the user must pivot in the exercise routine. The adjustable lever arm is connected at a pivot point to a support bar which is designed to rest against the back of the user's triceps. A shoulder harness extends from the top of the elongated support bar and supports the device on the user's shoulder. There is a hand grip at the end of the shoulder harness to be grasped by the user's hand on the non-exercising arm. At the end of the adjustable lever arm opposite the pivot connection is a hand grip which is grasped by the user and pulled on in the exercise routine. The spring applies the counter force to the adjustable lever arm and is the force which the user must overcome during exercising the muscles. With a leg strap the device can be strapped to the top of the user's leg between the hip and knee. The hand grip can then receive the bottom on the user's leg and the user can do leg curls to exercise the leg muscles. By means of attaching a rigid bar to the adjustable lever arm and with the device strapped to the user's leg, the exercise device can be also used to exercise the triceps. Accordingly, three different exercises can be performed with a single device.

The problem with these devices is that they fail to isolate the pectoral and deltoid groups in such a way that the completion of a repetition causes rotation of the shoulder joint while maintaining the forearms essentially coplanar, as they pivot about a point essentially maintained along a line connecting each shoulder joint. The prior art devices are further deficient in teaching an exercise device for performing a butterfly press type of exercise, wherein the particular arrangement of the resistance coil relative to the pivoting members is such that the surfaces of the medial to lower forearm are required to exert a particular degree of force in opposition to the resistance coil.

Thus, what is lacking in the art is a device for improving the strength and flexibility of the pectoral and deltoid muscle groups while effectively maintaining rotational flexibility about the shoulder joint.

SUMMARY OF THE INVENTION

The present invention provides a device which effectively surmounts the deficiencies of the prior art devices by providing an apparatus that efficiently isolates the shoulder joints and surrounding musculature to provide a strength and conditioning effect while maintaining flexibility about the joint.

The instantly disclosed butterfly exercise device is useful for isolating the pectoral and deltoid muscle groups while rotating the shoulder joint and forearm areas of the user. In its most basic form the device includes first and second members which are constructed and arranged to accept the user's forearm and hand. These members are hingedly engaged and are maintained in a first position by variable resistance means. A force, exerted by the user's forearms in opposition to the variable resistance means, moves the first and second members to a second position. Completion of the repetition involves returning to the initial position. While accomplishing the repetition, the user simultaneously rotates both shoulder joints to enhance flexibility while conditioning both the deltoid and pectoral muscle groups.

Accordingly, it is an objective of the instant invention provide a device for efficiently isolating the shoulder joints and surrounding musculature to provide a strength and conditioning effect while maintaining flexibility about the joint.

It is a further objective of the instant invention teach a butterfly exercise device useful for isolating the pectoral and deltoid muscle groups while rotating the shoulder joint and forearm areas of the user.

It is yet another objective of the instant invention to provide a butterfly exercise device having variable resistance means wherein a progressive conditioning and strength enhancing effect can be achieved.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Figure 1:
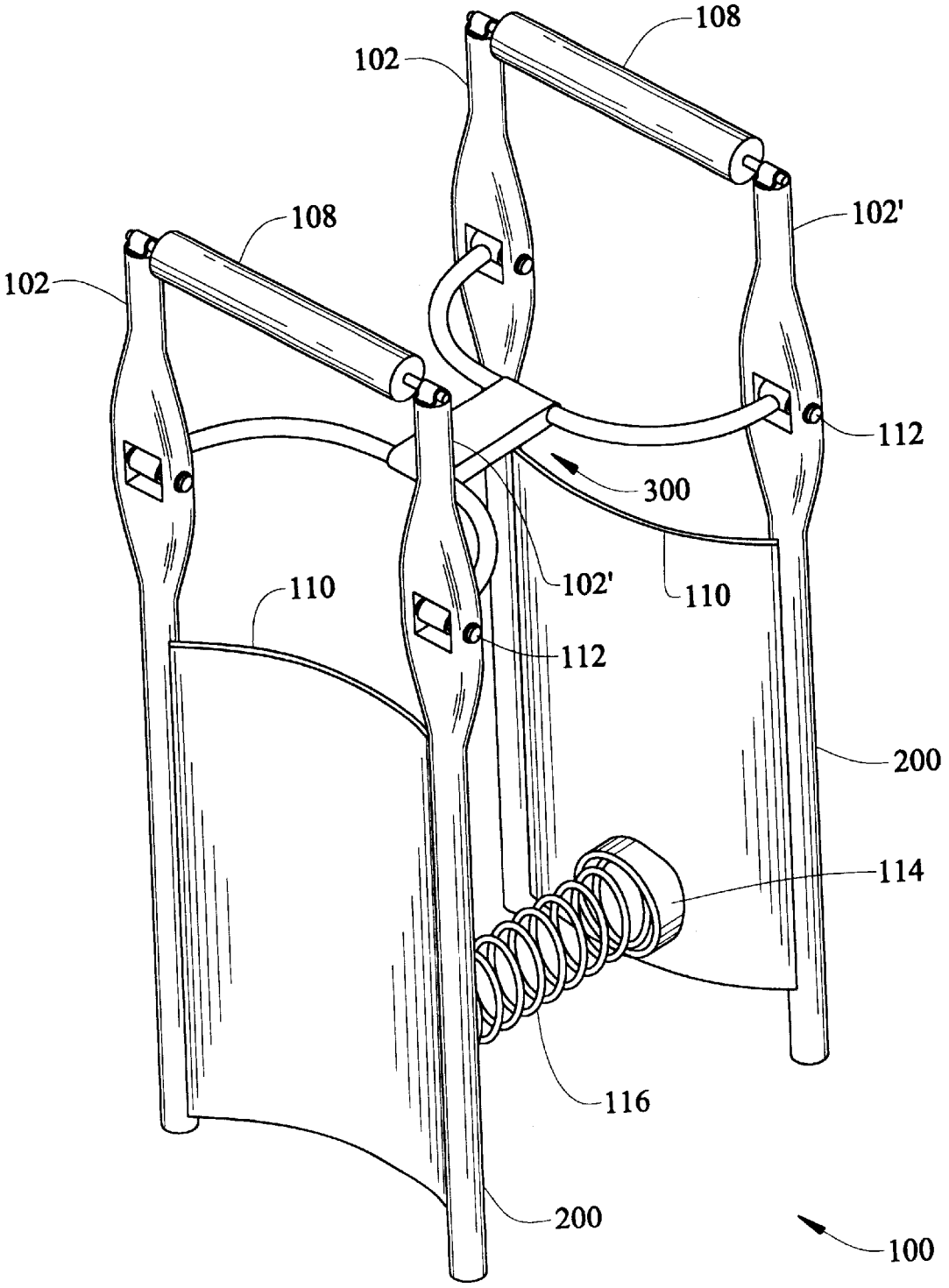
FIG. 1 is a perspective view of the instant exercise device.
Figure 4:
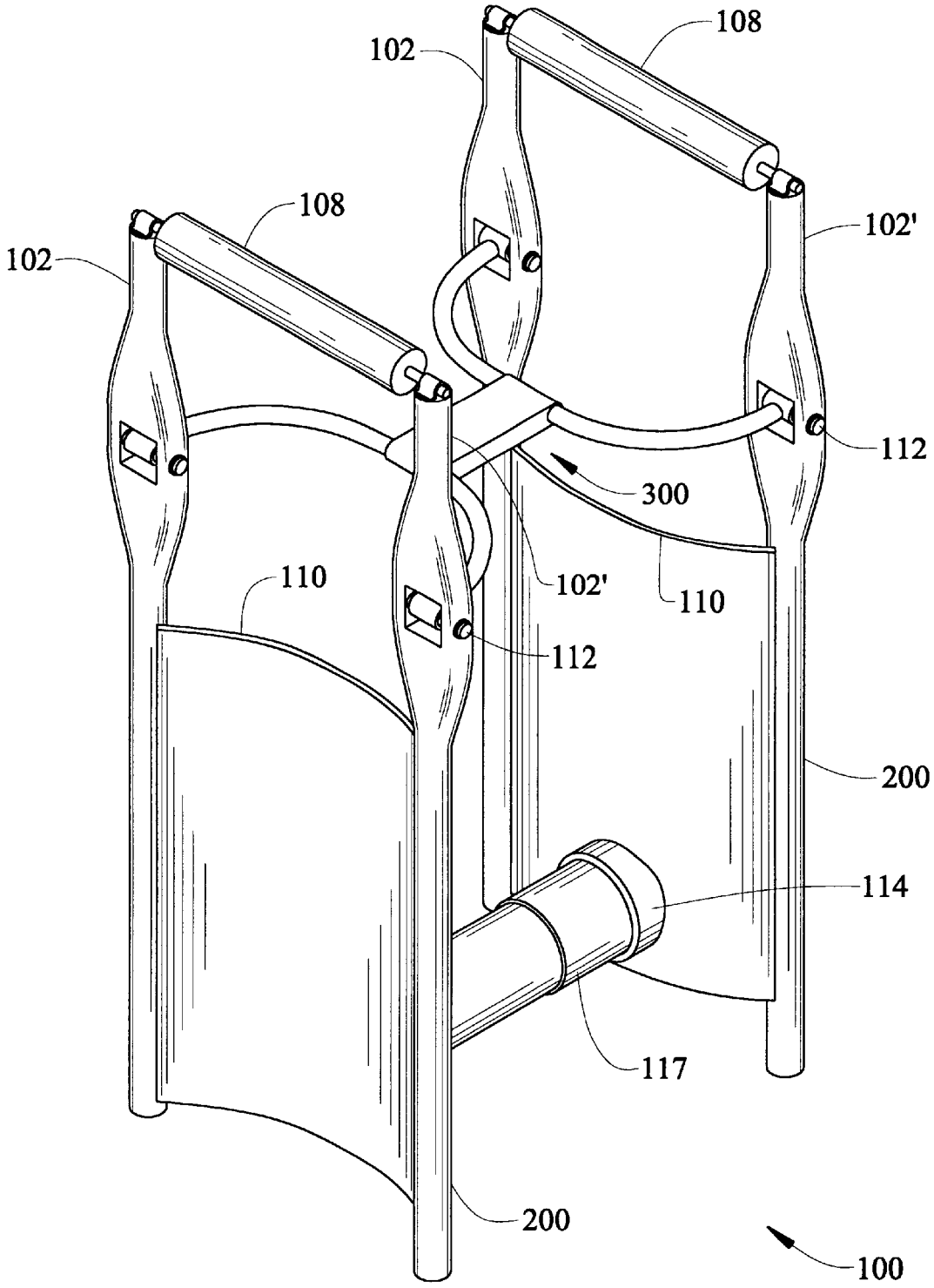
FIG. 4 is a perspective view of a modification of the instant exercise device of FIG. 1.

Now with reference to FIG. 1, the butterfly exercise device is generally referred to by numeral 100. The device comprises first and second members constructed and arranged to accept a user's forearm and hand. In a preferred, but non-limiting embodiment, said first and second members are illustrated as first and second pivotal assemblies 200, each of said pivot assemblies including first and second spaced apart rigid arms 102,102', having a proximal end and a distal end. At the proximal end thereof, support arms 102,102' are mechanically coupled to a hand engagement member 106 (see FIG. 2), which may be a rigid arm encased within a means for shock absorption, e.g. a resilient foam sleeve 108. Each pivotal assembly 200 further includes an area 110 which is in mechanical engagement with support arms 102,102' and is adapted to function as a forearm rest. Although any suitable shape could be utilized, in the preferred embodiment, as illustrated, the forearm rest 110 presents a concave profile for cradling of the user's forearm. Each arm 102,102' further includes means for pivotally coupling with connecting bar 300 by means of attachment pins 112. At the distal ends thereof, each pivotal assembly 200 includes a positioning means 114 for locating a source of variable resistance 116 therebetween. Although herein illustrated by a particular embodiment, the invention is not limited thereto, and any suitable arrangement is contemplated. With reference to the illustrated embodiment, the variable resistance device 116, may be a spring for providing increasing opposition to compression and decreasing opposition as the user returns to the original position, or alternatively may be in the form a power capsule 117, as shown in FIG. 4, which may be exemplified as a damped. hydraulic device, e.g. a shock absorption device which provides fairly constant resistance to forces in either direction.

Figure 3:
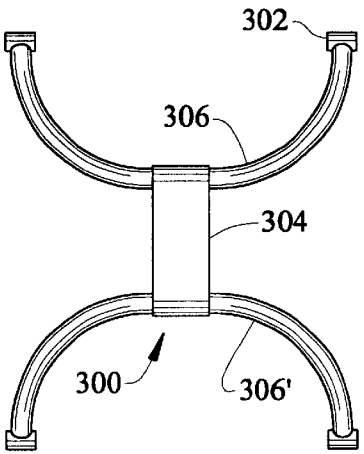
FIG. 3 is a side view of a pivotal forearm assembly.
Figure 2:
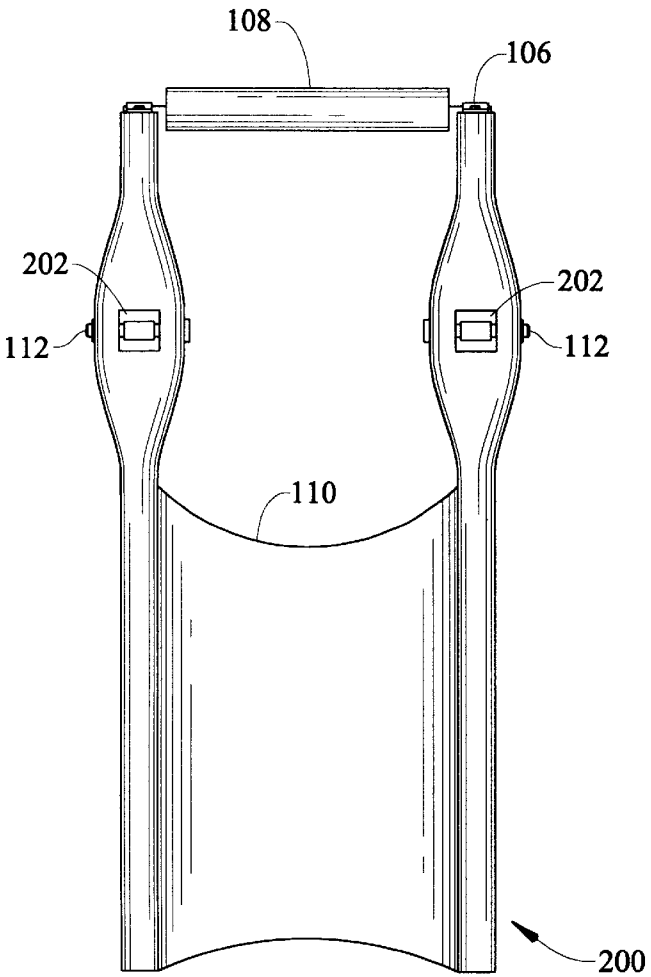
FIG. 2 is a top view of the connecting bar assembly.

With reference to FIGS. 2 and 3, the pivotal assemblies 200 and connecting bar 300 are more clearly illustrated. Pivotal assemblies are shown as having an opening 202 in each arm 102,102' for pivotal engagement of the connecting arm, exemplified (but not limited to) a plurality of cylindrical bearing members 302, which are adapted for insertion in openings 202 and pivotal engagement therewith by means of inserting a locking pin 112 therethrough as illustrated.

With reference to FIG. 3, the connecting bar assembly 300 is illustrated as being formed from connecting arms 306,306' each of which are maintained in rigid spaced apart relation by coupling member 304. Each of said connecting arms 306,306' terminate in bearing members 302 which are adapted for mechanical engagement with support arms 102, 102' as set forth above.

In operation, the user places each of their hands about one of the resilient foam sleeves 108, thereby positioning their respective forearms within the area 110. With elbows bent, the butterfly exercise device 100 is held in front of the individual. The initial movement involves rotating the shoulders to bring the elbows-together against the force of variable resistance means 116, followed by relaxing the arms and returning to the starting position. This may be accomplished in either a sitting or standing position, or while lying on one's back. The above-described mode of use effectively isolates the pectoral and deltoid muscle groups while permitting rotation of the shoulder joints, thereby promoting a muscular conditioning effect and enhanced joint flexibility.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. An exercise device for isolating the pectoral and deltoid muscle groups of a person's body while rotating the shoulder joints comprising:

a first elongated pivotal assembly having a proximal end and a distal end, said proximal end adapted to engage one hand;

a second elongated pivotal assembly having a proximal end and a distal end, said proximal end adapted to engage a second hand;

an elongated connecting bar assembly extending between said proximal end of said first elongated pivotal assembly and said proximal end of said second elongated pivotal assembly fixing the distance between said first elongated pivotal assembly and said second pivotal assembly; and a source of variable resistance having a first end and a second end, said first end and said second end connected near said distal ends, respectively, of said first elongated pivotal body and said second elongated pivotal body;

wherein a force exerted by a person's forearms operates against said source of variable resistance to manifest a body conditioning and flexibility enhancing effect.

2. An exercise device in accordance with claim 1 wherein:

said source of variable resistance is a coil spring.

3. An exercise device in accordance with claim 1 wherein:

said source of variable resistance is a power capsule.

4. An exercise device in accordance with claim 1 wherein:

each said pivotal assembly includes a pair of support arms, said support arms each including a proximal and a distal end and an area for contacting a person's forearms, wherein each said support arm is constructed and arranged for pivotal engagement with said connecting bar assembly whereby the distance between said distal ends changes in response to a force exerted by a person.

5. An exercise device in accordance with claim 1 wherein:

each said pivotal assembly further includes hand engagement means located at said proximal end thereof.

6. An exercise device in accordance with claim 5 wherein:

each said hand engagement means further includes shock absorption means.

7. An exercise device for isolating the pectoral and deltoid muscle groups while rotating the shoulder joint of a person comprising:

a first elongated assembly with a proximal end and a distal end, said first assembly having at least one support arm longitudinally attached to a cradle for resting a forearm, said support arm having a hand engagement member at said proximal end, said support arm including a hinge portion adjacent said hand engagement member;

a second elongated assembly with a proximal end and a distal end, said second assembly having at least one second support arm longitudinally attached to a cradle for resting the other forearm, said second support arm having a second hand engagement member at said proximal end, said second support arm including a second hinge portion adjacent said second hand engagement member;

an elongated rigid connecting bar with a first end and a second end, said first and second end each having a cooperating hinge portion thereon, said cooperating hinge portion of said first end of said connecting bar pivotally attached to said hinge portion of said first support arm and said cooperating hinge portion of said second end of said connecting bar pivotally attached to said second hinge portion of said second support arm; and said distal end of said first support arm and said distal end of said second support arm each connected in opposing relationship to a variable resistance mechanism interposed therebetween;

whereby opposing force exerted by the forearms of a person on said first and second support arm causes pivoting movement of said proximal ends adjacent the hands and bringing the elbows together at said distal ends.

8. An exercise device in accordance with claim 7 wherein said hinge portion of each of said first and second support arm includes an opening therethrough, said opening housing a removable pin ; and said cooperating hinge portion of said first and second end of said connecting bar includes an aperture therethrough, said pin inserted through said aperture.

9. An exercise device in accordance with claim 8 wherein said first and second elongated assembly each includes a second support arm parallel to said at least one support arm, said cradle extending between each of said first and said second support arm, said cradle attached longitudinally to said second support arm and said hand engagement member extends between said first and second support arm.

* * * * *